US006070936A

United States Patent [19]

Holland

[11] Patent Number: 6,070,936

[45] Date of Patent: Jun. 6, 2000

[54] TODDLER TABLE WITH A PLURALITY OF INTEGRAL CHILD SEATS

[76] Inventor: Glenn Holland, 832-202 Purser Dr., Raleigh, N.C. 27603

[21] Appl. No.: 09/172,813

[22] Filed: Oct. 15, 1998

[51] Int. Cl.[7] ..... A47D 13/00

[52] U.S. Cl. ..... 297/232; 297/136

[58] Field of Search ..... 297/135, 136, 297/142, 157.1, 174, 232; 108/119, 147.19, 147.21; 248/188.5

[56] References Cited

U.S. PATENT DOCUMENTS

| | | | |
|---|---|---|---|
| D. 356,689 | 3/1995 | Mariol | D6/339 |
| D. 364,746 | 12/1995 | Lerner et al. | D6/333 |
| D. 382,719 | 8/1997 | Conrado et al. | D6/333 |
| D. 383,911 | 9/1997 | Conforti et al. | D6/339 |
| 2,556,611 | 6/1951 | Borgman | 108/147.21 X |
| 3,366,415 | 1/1968 | Cooper | 297/135 X |
| 3,560,046 | 2/1971 | Brosk | 297/157.1 |
| 3,688,419 | 9/1972 | Woolman | 297/157.1 X |
| 5,046,782 | 9/1991 | Lundeen | 108/119 X |
| 5,562,052 | 10/1996 | Glashouwer et al. | 108/147.21 |
| 5,584,531 | 12/1996 | Bowman | 297/136 X |

*Primary Examiner*—Peter R. Brown

[57] ABSTRACT

The present invention consists of a table with a top which is substantially shaped in the form of a circular segment such as a quarter circle or a semi-circle wherein a plurality of integral seat openings with seat backs and bottoms can accommodate a plurality of toddlers safely and easily for entertainment, education or supervision during play. The table top is preferably rotomolded from polyethylene or other hard polymer for ease and economy of assembly, manufacture and use. Preferably quarter circle segments are fitted with four integral seat backs and bottoms so that groups of four, eight or even twelve toddlers can be accommodated around a singular day care worker or educator. The table further has two u-shaped depending steel tubular legs which are located at either end of the table which allows the table to quickly and easily be adjusted by preschool or day care center staff.

9 Claims, 6 Drawing Sheets

TODDLER TABLE WITH A PLURALITY OF INTEGRAL CHILD SEATS

FIELD OF THE INVENTION

The present invention relates to the field of tables which have a plurality of seats integral to the top of the table, which seats are arranged in a quarter circle or hemispherical fashion. Currently, in day care or preschool settings, it is highly desirable to be able to care for large groups of children by one or two teachers or day care workers. Typically, there are tables present in the marketplace having a semi-circular table top with a plurality of seats around the periphery which the children can sit in. Such tables are often arranged in a quarter circle or semi-circular arrangement so that all the young children face toward the education provider or worker. This makes it relatively simple and pleasant to accomplish tasks with up to six or eight young children, such as occurs during story time or meal time.

BACKGROUND OF THE INVENTION

In the past, there have been only a few designs relating to semi-circular seating arrangements for children around a teacher or other education provider. The only prior patented design of a similar nature can be seen in U.S. Pat. No. 3,366,415 issued to J. W. Cooper in which a semi-circular table is built for the older school child and has seats which permanently attached to the table by providing steel tubing depending between pairs of seats and extending towards the center of the table. The steel tubing is attached to the outer periphery of the underside of the table top. Thus, the chairs cannot move out of place and fewer legs are left to clean around and under by maintenance personnel. Further a blackboard or corkboard for messages may be attached directly to one corner of the table top. However, In the Cooper design, the seats are not integral to the tabletop, so the design is not suited to young children, especially toddlers.

However, by far the most readily available product in the market place consists of a semi-circular table, or other circular segment portion, which allows for the placement of standard detached chairs to be arranged around its periphery. Although this is suitable for school aged children, it would not keep busy, antsy preschoolers happily in place. They would move the chairs all over the place and not necessarily sit in them for extended periods because they have very short attention spans of a minute or less.

Most recently, sometime ago a design was developed by the inventor of the instant invention wherein a substantially rectangular table top was outfitted with a plurality of seats for up to eight children. A small semi-circle cut out was made for the teacher or day care worker. In this design, a Formica type table top was used with hard molded drop in seats which were secured to corresponding apertures in the table top. Such a design was extremely popular with educators and caretakers of very young children in the age range of approximately 5 to 24 months. Table top arrangements were available to seat 4, 6 or 8 children.

Thus, nowhere in the prior is seen a table top with a plurality of integral seats arranged in a semi-circular fashion within a semicircular table top. Nor is there seen anywhere in the prior art a semicircular, rotomolded table top with a plurality of seats which has the seats integral to the table top for ease of manufacture and cleaning by the user and their attendant maintenance personnel.

SUMMARY OF THE INVENTION

The present invention consists of an improved table for handling a relatively large number of young children while teaching, feeding or educating them in a single sitting. The invention consists of a table fashioned in a circle segment, typically a quarter circle which is provided with a plurality of apertures with integrally molded seat backs and bottoms into which the child may be easily slid by the day care worker or teacher. Seat belts are recommended and provided for added security. The table top is preferably made from rotomolded hard plastic, such as polyethylene or other suitable polymer.

The tables may be made with two, three or four integrally molded seats arranged in a quarter circle or four, six or eight integrally molded seats in a semicircle. In such a manner, two or even three quarter circle segments may be grouped and used as modular furniture. The use of rotomolded polyethylene means that the table may be made more economically than even before, and the top may have a pleasing sleek appearance, with no grooves or indentations for food to accumulate in which are difficult to clean and result in unsanitary surfaces.

Further the improved table design provides for a thickened seat leg support portion which depends from underneath the table and attaches to the top of the seat bottom. Because of this improved design, the table may be used with larger, heavier toddlers. With the older, Formica table top design, the largest toddler the table could safely hold was approximately 24 months or 25 lbs. With the new table top design with the rotomolded seats and backs and depending triangular leg support, the present invention can safely hold a toddler up to approximately 36 months and approximately 40 lbs. However, care should be used with children that may be unusually large or heavy for their age for proper fit and placement. Some children may outgrow use of the table before 36 months.

Two u-shaped depending tubular legs are provided which fit into corresponding cylindrical apertures or sleeves molded into the four corners of the bottom of the table. The legs are substantially u-shaped, with the top of each "u" formation fitting into each of the four cylindrical sleeves located substantially near each of the four corners on the underside of the table.

It is also a feature of the present design, that the rear leg supports comprise a triangular element which extends well beyond the rear edge of the table top so that the width of each u-shaped leg is increased for greater stability. Also, a curving bend at the distal end of each -shaped leg provides even greater width of the base of the "u" for improved stability. Such a leg design makes it practically impossible for toddlers to topple over the table, even if it is climbed upon by the toddlers.

The legs may be made adjustable in height, preferably from 22"–27" tall by providing a tubular bracket with opposing pin holes which are adapted to receive and secure a corresponding pin through the bracket and leg hole. These pin holes are placed in opposing rows on both the end of the table leg and the cylindrical bracket and are spaced approximately 1" apart. Of course, other arrangements of adjustments for table legs are well known in the art and should be considered as part of the scope of the present invention.

Because the design provides for a single table top with integrally molded seats and only two unshaped tubular legs which depend from the underside of the table top, it is a simple matter for either the manufacturer or the end user to set up the table. In the past, each drop in seat had to be fitted within the table top. Thus, the improved design of the present invention provides for greater ease of assembly and set up.

OBJECTS OF THE INVENTION

Thus, it is one primary object of the instant invention to provide a table suitable for use with a plurality of toddlers having integrally molded seats in a table top having a quarter circular or other circular segmented shape so that the toddlers can be easily supervised during play time, feeding time or when being entertained by a single day care worker or educator.

It is an additional primary object of the instant invention to provide a table suitable for use with a plurality of toddlers comprising a circular segment portion which is easily and conveniently made from rotomolded polyethylene or other inexpensive polymer.

It is further a primary object of the instant invention to provide a table suitable for use with a plurality of toddlers having two u-shaped adjustable tubular legs on either end of the table top.

It is yet another primary object of the instant invention to provide two u-shaped adjustable tubular legs which have a curve at the rear end of each "u" to increase width of the legs and provide enhanced stability of the toddler table.

It is yet another primary object of the instant invention to provide extended triangular supports in the outer periphery of the table to yet further increase the width of each u-shaped leg to provide enhanced stability of the toddler table.

It is further a primary object of the present invention to provide a table suitable for use with a plurality of toddlers which design can be easily altered to seat two, three or even four toddlers in a table top which is shaped in a quarter circle arrangement so the tables may be used in a modular fashion to seat up to eight toddlers in a semi-circle or twelve toddlers in a three-quarters circle.

It is further a primary object of the present invention to provide a table suitable for use with a plurality of toddlers which is made from rotomolded polyethylene or other suitable hard polymer which has integral seats each with back and bottom portions of increased thickness to hold larger and heavier toddlers safely.

These and other objects and advantages of the present invention can be readily derived from the following detailed description of the drawings taken in conjunction with the accompanying drawings present herein and should be considered as within the overall scope of the invention.

DETAILED DESCRIPTION OF THE DRAWINGS

Figure 1:
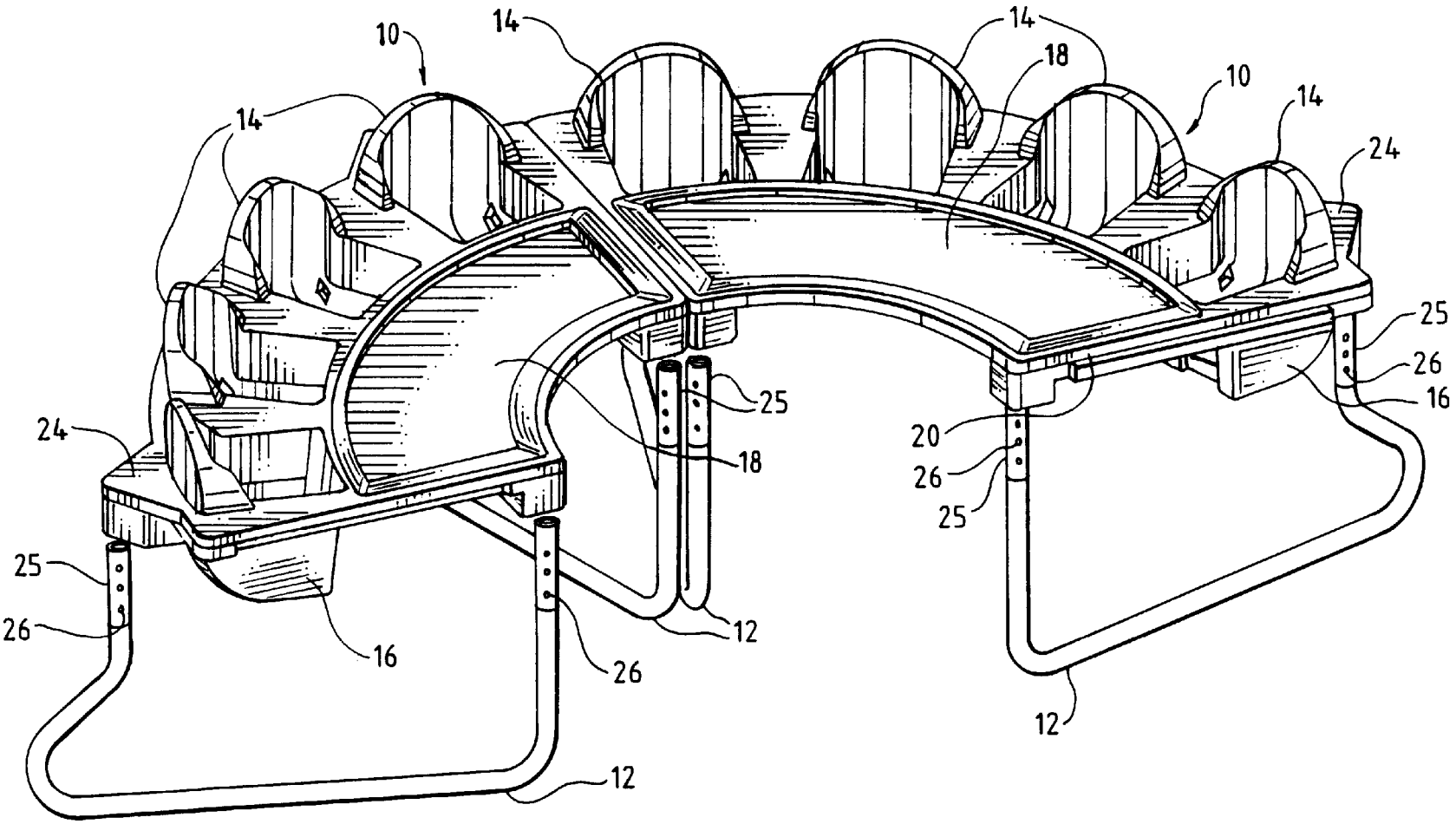
FIG. 1 is a front perspective view of two quarter circle segment table tops with integral seats shown used together to create safe, secure seating for up to eight toddlers.

Shown in FIG. 1 is a front perspective view of two toddler tables 10 showing four integral child seats with seat backs 14 and seat bottoms 16 in each toddler table 10. A quarter circle slight depression or indentation 18 is provided in table top 20 as a containment device for spills or toys that roll to prevent the toy or spill from leaving table top 20. Also shown at one end are end tab 42 which is adapted to be received within tab recess 44 of an adjoining table. In such a manner two toddler tables 10 may be readily joined and properly aligned. This particular design of toddler table 10 has a quarter circle segment table top 20, although other circular segment portion designs for the table top, such as semicircles or 180° arcs, 120° arcs and other forms and arrangements may be used to accomplish a similar purpose; that is, providing for a plurality of integral seats within table tops which may be used in a modular fashion to accommodate a wide variety of seating needs wherein many toddlers may be fed, educated, entertained or supervised during play by one educator or day care staff worker.

Also shown is table height adjustment leg bracket 25 which is provided with pairs of opposing pin holes 26 in either side of tubular steel leg 26. Corresponding pin holes are fashioned into the top leg portions of unshaped tubular legs 12 so that a pin may be slipped therethrough to adjust the overall height of toddler table 10. A table height of 23–27" is preferred for toddlers in the 24 to 36 month range. U-shaped tubular table leg 12 is provided at either end of table top 20 to stabilize and support the table top when loaded down with young children and their toys and books. This unshaped tubular table leg 12 is formed such that it extends well behind the table back into triangular leg support 24 so that the young children contained therein do not topple the toddler table 10 over by wiggling or climbing on the toddler table 10. With such a design of table leg 12 which is unshaped and extends well behind table top 20, together with the fact that the table top 20 itself has a triangular portion 24 which extends well behind the back portion of table top 20, this provides for an extremely stable table design for toddler table 20. It should also be noted that the two table legs 12 are well splayed out from one another, adding significantly to the stability of toddler table 10.

Figure 2:
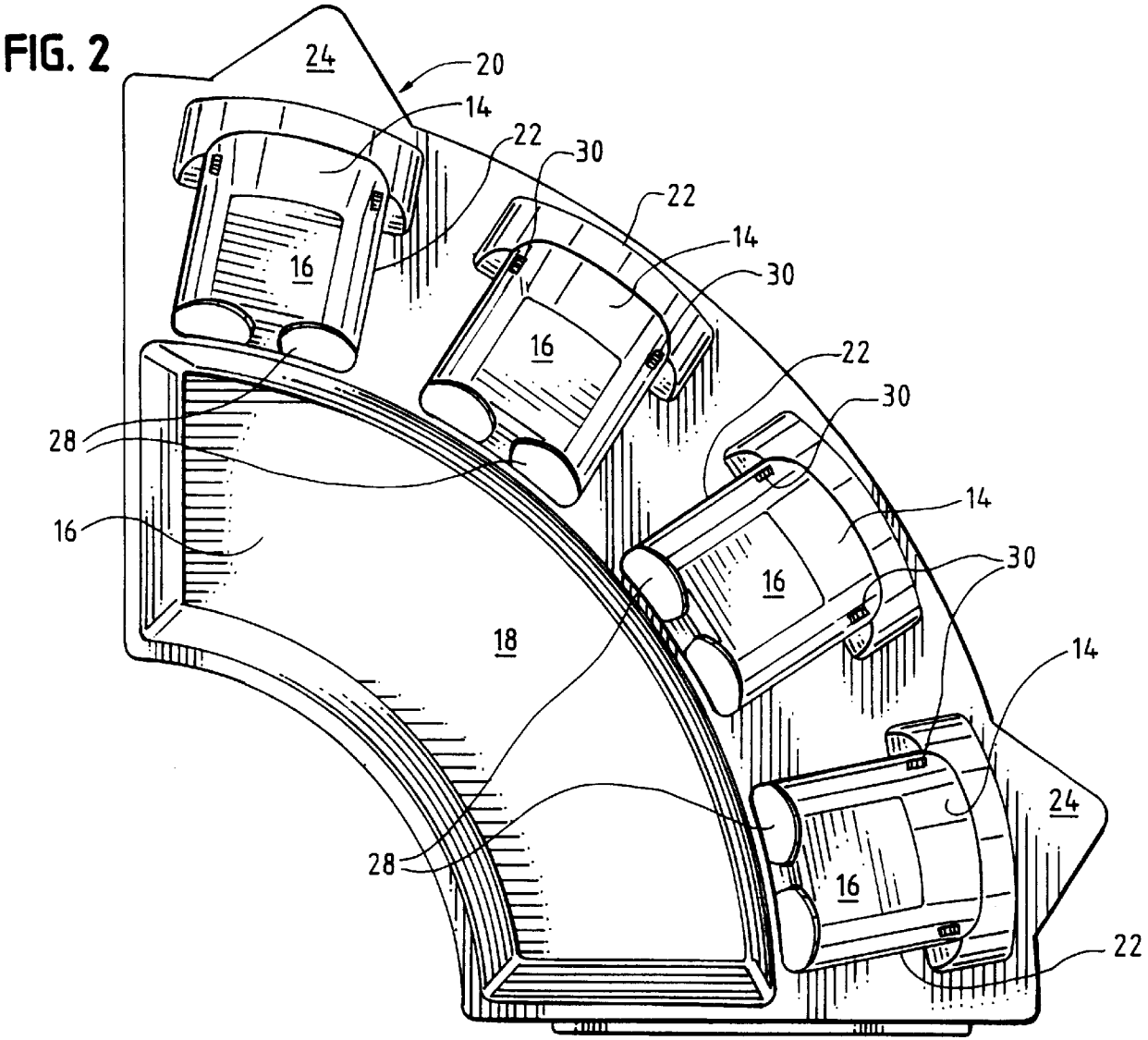
FIG. 2 is a top plan view of the present invention showing four integral toddler seats in a quarter circle segment table top.

FIG. 2 shows a top plan view of toddler table 10 with four integral child seats comprising seat opening 22 which as seat back 14, seat bottom 16 and a pair of leg openings 28 which the toddlers legs may be easily slipped therethrough when inserting or removing the toddler from table top 20. Although table top 20 is substantially formed in the shape of a quarter circle with four integral seats, it should be understood that other circular portions or segments may also be used with various numbers of seats positioned therein, depending upon the amount of table top space desired per child for the activity selected. Slight depression or indentation 18 is shown which is used to prevent spills or toys from rolling over the edge of table top 20.

At the rear of table top 20 is shown triangular support elements 24 which house the table legs from underneath the surface of the table. For added security, pairs of seat belt openings 30 are shown. A seat belt may be readily passed though either side of these openings 30 to help prevent the toddler from climbing out and possibly falling and injuring himself or herself during use.

Preferably, table top 20 is rotomolded from a hard polymer or plastic such as polyethylene. Such a construction is light and durable and should provide for years of pleasurable use, even in a commercial setting such as a preschool or day care.

Figure 3:
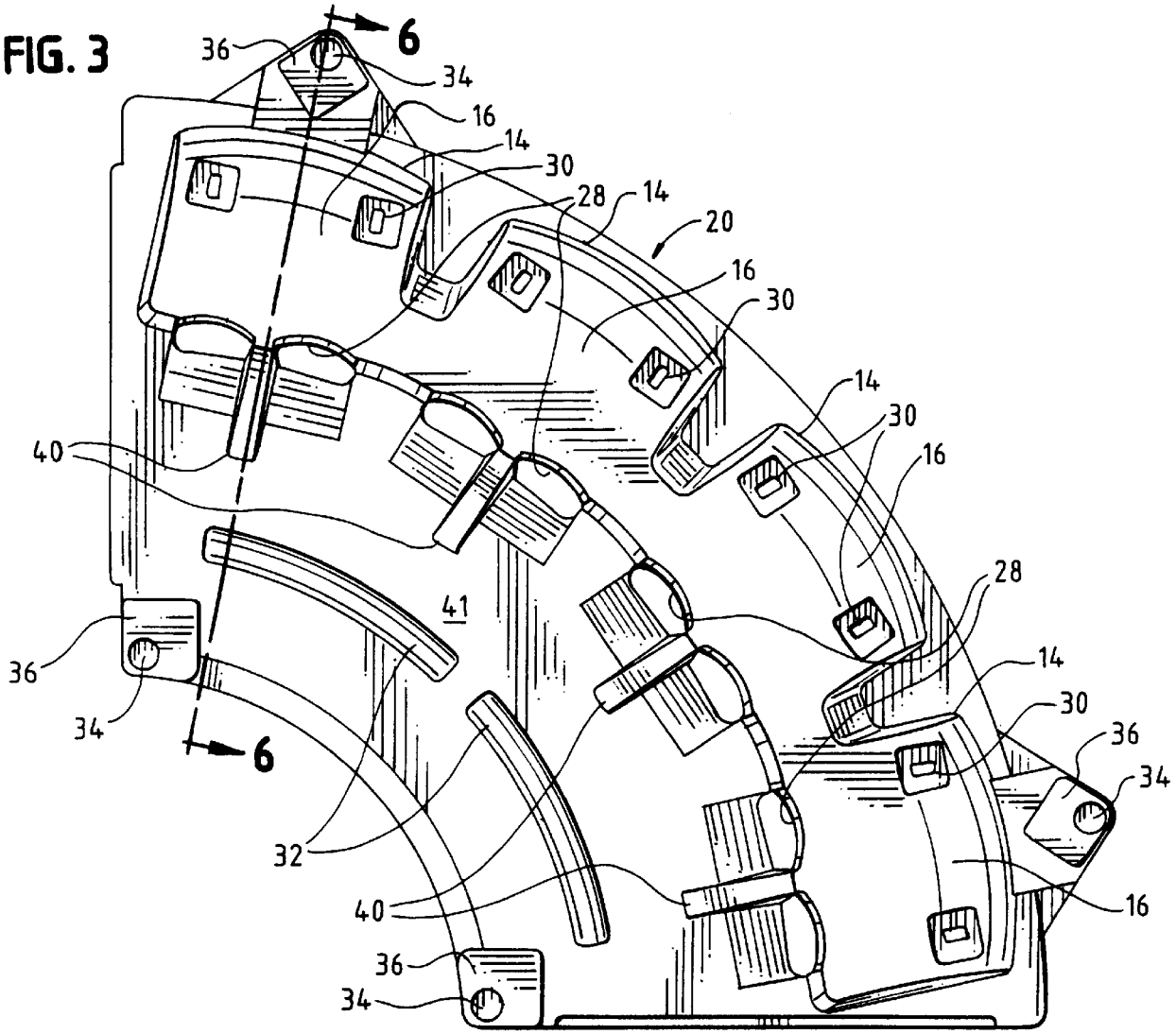
FIG. 3 is a bottom plan view of the present invention showing four integral toddler seats in a quarter circle segment table top.

FIG. 3 shows a bottom plan view of table top 20 showing its construction from underneath. Seat backs 16 and bottoms 14 are reinforced for durability and to hold larger toddlers by providing triangular seat bottom support elements 40 which depend from the underside of table top 20 to the leading edge of seat bottom 14. This seat bottom support element 40 is positioned directly between the pair of leg openings 28. In such a manner, the seat bottom support element 40 makes it possible for larger and heavier toddlers to be held within the toddler table 10.

Also shown in FIG. 3 are mold support recesses 32 which bear against and support table top spill depression 18 so that after a period of time of wear and tear upon the toddler table 10, the top does not sag into and against the underside 41. Also shown are seat belt openings 30 which are provided so that a seat belt or other securement device may pass therethrough. The end tab 42 can be easily seen which is adapted to fit and receive a similarly shaped tab recess 44 which would be found in an adjoining toddler table. In addition, table leg support elements 36 are positioned in the table underside 41; two near the interior of the table and two at the rear of the edge seats which are set well back from seat back 14 to provide for added stability of toddler table 10. In each of table leg support elements 36 is positioned a cylindrical sleeve opening 34 which is adapted to fit the table height adjustment leg bracket 25, shown in FIG. 1. In such a manner, table legs 12 may be easily and securely fitted into the underside of toddler table 10.

Figure 4:
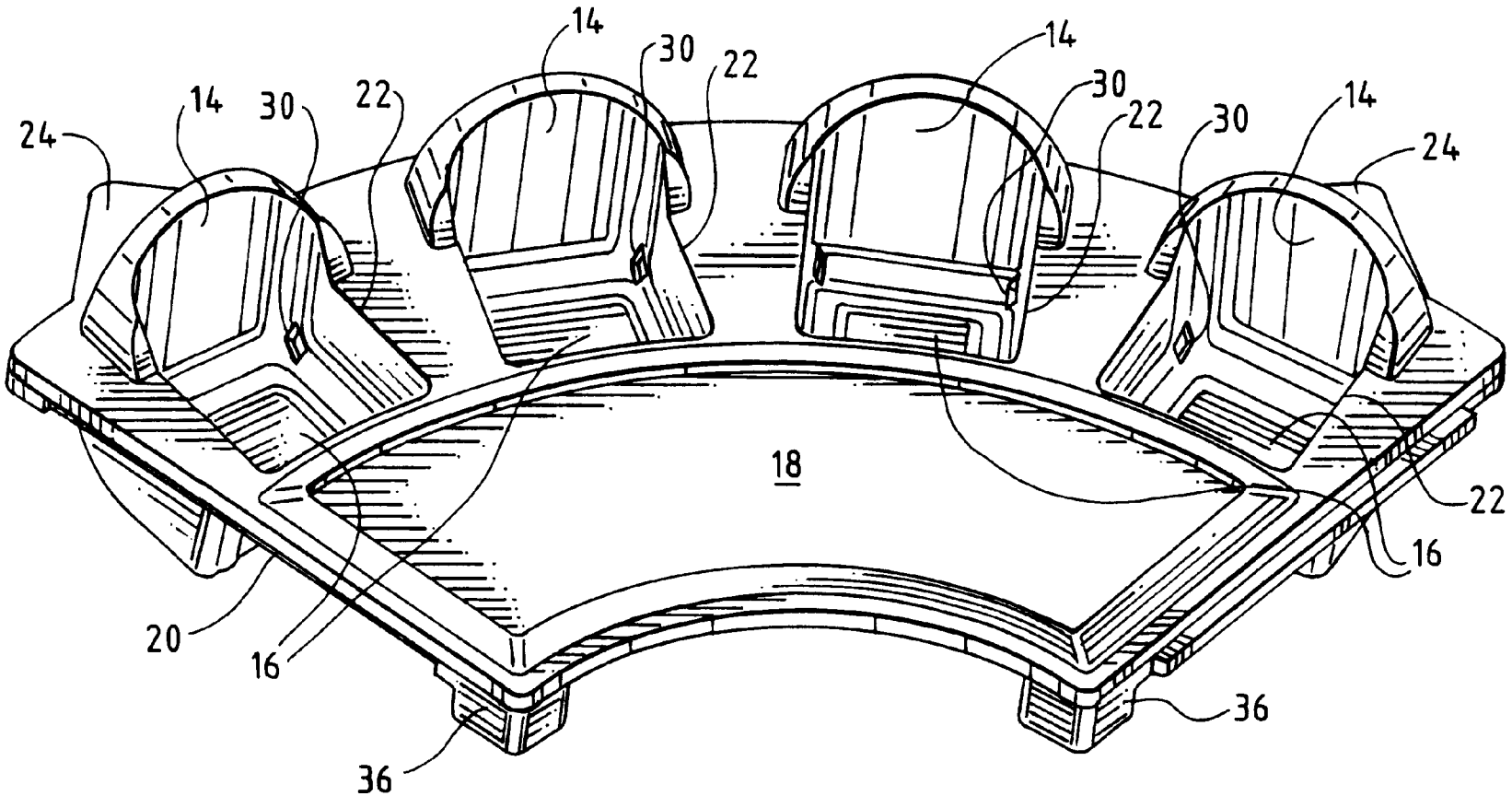
FIG. 4 is a front perspective view of the present invention showing a quarter circle segment table top with four integral toddler seats.

FIG. 4 shows a front perspective of a quarter circle segment shaped table top 20 which shows comfortable bucket type seats with seat backs 14 and seat bottoms 16 fitted into seat openings 22. Because the seats are integral to table top 20 there are no unsanitary crevices which may accumulate dirt and food particles over time. Moreover, there is no assembly wherein separate seats must be fitted into and secured within the table top.

Figure 5:
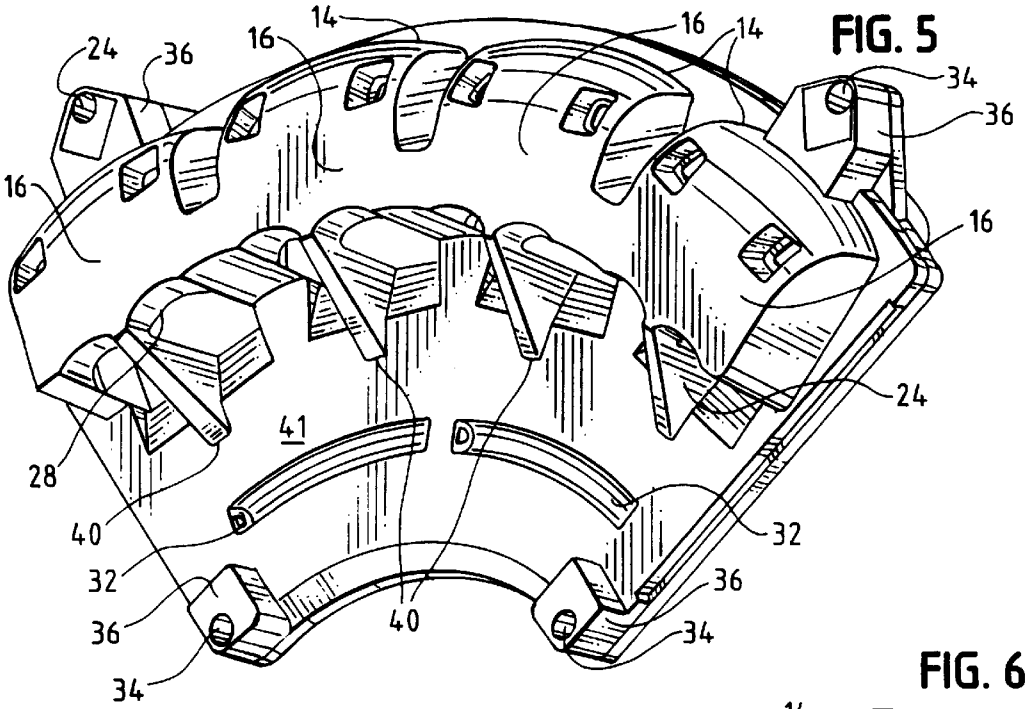
FIG. 5 is a bottom perspective view of the present invention showing a quarter circle segment table top with four integral toddler seats.

FIG. 5 shows a bottom perspective view of a quarter circle segment shaped table top 20 which shows seat backs 14 and seat bottoms 16 which are stabilized and supported by substantially triangular seat bottom support elements 40 which are integral to table top underside 41. Although this view shows that the seat bottoms 16 are actually one contiguous form, it should be understood where the seats are spaced further apart to provide for more room between children, other mold configurations for the seat bottoms may be used, although this particular configuration provides for simplicity of design and added strength to the present invention.

Figure 6:
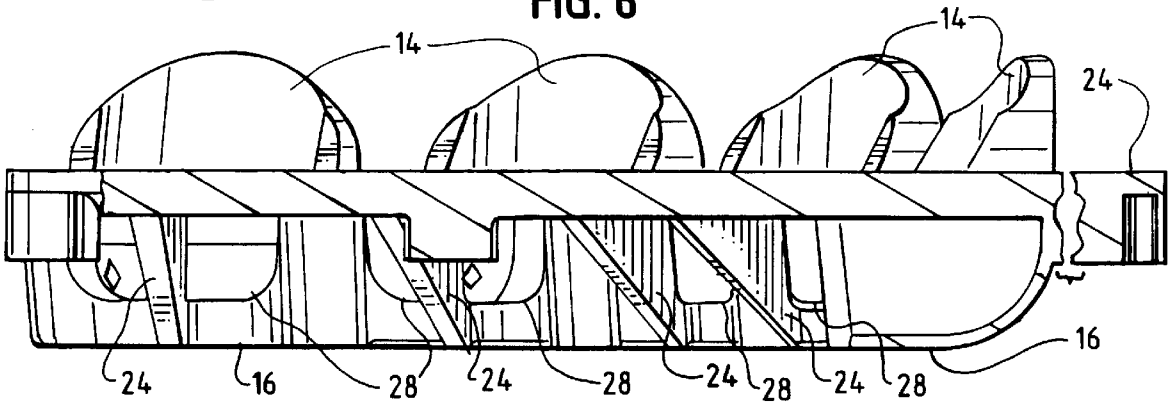
FIG. 6 is an end view of the present invention.

FIG. 6 is an end view of the present invention, toddler table 10 in which is shown the curvature of the table top 20, the relative positioning of seat backs 14 and the positioning of substantially triangular seat bottom support elements 40.

Figure 7:
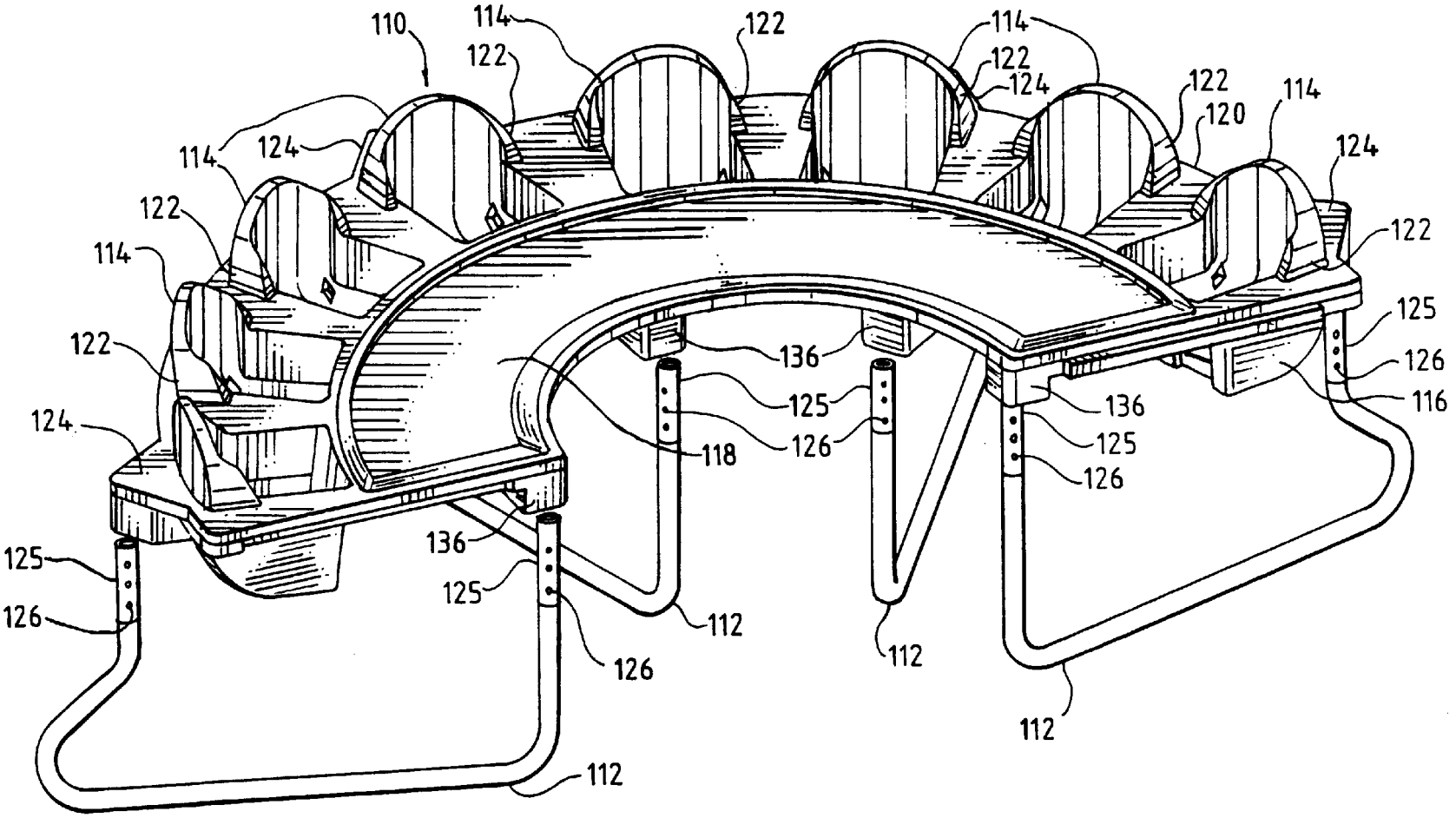
FIG. 7 is a second variation of the present invention showing a semicircular table top eight integral toddler seats.

FIG. 7 shows a slightly different version of the present invention in perspective, toddler table 110 which has a table top 120 which is semicircular in configuration with seat backs 114 and seat bottoms 116 provided in seat openings 122. A semicircular slight indentation or depression 118 is provided in table top 120 to contain spills and prevent toys from rolling off the edges of table top 120. End tab 142 and tab recess 44 are provided so that toddler table 110 can be used in a modular fashion and may be attached to additional quarter circle segment toddler tables to seat up to eight toddlers. A set of four tubular steel u-shaped legs 112 are provided which are fitted with table height adjustment leg brackets 125 which have two opposing rows of pin holes 125 along their length. Corresponding rows of pin holes are provided at the end of each tubular steel unshaped leg which allows the table height to be readily adjusted by day care or school staff by simply removing a pin, positioning the leg bracket 125 to the desired position along the end of the table leg and inserting a steel pin therethrough. In such a manner, the height may be adjusted conveniently and simply by anyone desiring to do so. The table height adjustment leg brackets 125 are held securely within table leg support elements 136 which provide stability. Further stability is provided by the extension of triangular leg support elements 124 which extend well beyond the rear of the table top 120. In such a manner, it would be very difficult for the toddler table 110 to topple over, even if it were climbed upon by several young children.

Although in the foregoing detailed description the present invention has been described by reference to various specific embodiments, it is to be understood that modifications and alterations in the structure and arrangement of those embodiments other than those specifically set forth herein may be achieved by those skilled in the art and that such modifications and alterations are to be considered as within the overall scope of this invention.

What is claimed is:

1. A table having a top and depending legs wherein the table top has seat openings formed within the periphery of the table top and with seat backs depending from each opening and bottoms directly adjacent to each seat back wherein the seat backs and bottoms are integrally formed with the table top and the table is suitable for seating at least two children wherein the table top is further substantially shaped in the configuration of a portion of a circle.

2. The table according to claim 1 wherein the table top is made from rotomolded polyethylene or other suitable hard polymer.

3. The table according to claim 1 wherein a substantially triangular support element depends from the underside of the table top adjacent each seat opening and connects to and supports each seat bottom.

4. The table according to claim 1 wherein the legs comprise two u-shaped steel tubes each with two upper tubular portions which interconnect with the table top, and one lower portion which is substantially flat and is intended to rest upon or near the ground or a floor surface which provided stability to the table structure.

5. The table according to claim 4 wherein the legs further have open portions at either end and the table top has an underside with at least two sleeve openings at either end, which sleeve openings are adopted to fit and receive each of the open portions of the u-shaped steel tubes.

6. The table according to claim 5 wherein the legs further have adjustment means to adjust the height of the table.

7. The table according to claim 1 wherein the shape of the table top is substantially a quarter segment of a circle.

8. The table according to claim 7 wherein the table top has four seat openings and corresponding seat backs and bottoms.

9. The table according to claim 1 wherein the shape of the table top is substantially a semi-circle.

* * * * *